US005385063A

United States Patent [19]

Wang

[11] Patent Number: 5,385,063

[45] Date of Patent: Jan. 31, 1995

[54] TRANSMISSION MECHANISM FOR MAGNETIC DAMPING TYPE STEP MACHINE

[75] Inventor: Leao Wang, Taichung Hsien, Taiwan, Prov. of China

[73] Assignee: Greenmaster Industrial Corp., Taichung Hsien, Taiwan, Prov. of China

[21] Appl. No.: 60,920

[22] Filed: May 13, 1993

[51] Int. Cl.[6] ..... A63B 23/04

[52] U.S. Cl. ..... 74/89.22; 74/108; 482/52

[58] Field of Search ..... 482/52, 53; 74/89.22, 74/89.2, 108

[56] References Cited

U.S. PATENT DOCUMENTS 3,954,282 5/1976 Hege ..... 74/89.2
4,708,338 11/1987 Potts ..... 482/52
5,135,447 9/1992 Robards, Jr. et al. ..... 482/52
5,199,931 4/1993 Easley et al. ..... 482/52
5,238,462 8/1993 Cinke et al. ..... 482/52

*Primary Examiner*—Edward K. Look
*Assistant Examiner*—Michael S. Lee
*Attorney, Agent, or Firm*—Bacon & Thomas

[57] ABSTRACT

A transmission mechanism for a magnetic damping type step machine includes two supporting plates bilaterally fastened to a machine base in the middle to hold a main shaft, a double-groove spool mounted around the main shaft to hold a flywheel, two pedals pivotably connected to a rear crossbar of the machine base at either side, each pedal having pedal rod with a foot plate and a linking rod with a locating plate respectively disposed at two opposite sides by the respective supporting plate, and two transmission wires, each transmission wire having one end wound round either groove of the double-groove spool in either direction and an opposite end turn over pulleys on the respective supporting plate and the locating plate of the respective pedal.

4 Claims, 5 Drawing Sheets

TRANSMISSION MECHANISM FOR MAGNETIC DAMPING TYPE STEP MACHINE

BACKGROUND OF THE INVENTION

The present invention relates to a transmission mechanism for a magnetic damping type step machine which uses transmission wires and pulleys to turn a flywheel between reversed directions alternatively.

Various magnetic damping devices are known, and widely used in body building apparatus (or more specifically in standing bicycles). Chinese Patent No. 167,914 discloses a magnetic damping control mechanism for an exercising machine which comprises a gear wheel mounted on the machine base and driven by two pedals, a belt wheel mounted on the machine base at the front and linked to the gear wheel by a chain, and a flywheel driven by the belt wheel through a transmission belt, and a device disposed below the flywheel and controlled to provide a magnetic damping resistance to the flywheel. FIG. 1 illustrates a step machine which is approximately similar to the structure of the aforesaid magnetic damping mechanism for an exercising machine. Because the pedal has a limited moving range, the gear wheel is turned in either direction through a limited angle, and therefore the revolving speed of the flywheel is limited. Because the revolving speed of the flywheel is limited, the cutting resistance from the electromagnetic device is relatively small. Therefore, an additional control device must be used to regulate electric current to the electromagnetic device. This arrangement simultaneously complicates the structure of the machine and also increases its cost. Further, because the gear wheel and the belt wheel are respectively mounted on the machine base at two opposite ends, the size of the machine can not be reduced.

SUMMARY OF THE INVENTION

The present invention has been accomplished under the aforesaid circumstances. It is therefore the principal object of the present invention to provide a transmission mechanism for a magnetic damping type step machine which uses transmission wires to link up the pedals with the flywheel so that the flywheel can be alternatively turned in either direction at a relatively higher speed. It is another object of the present invention to provide a transmission mechanism for a magnetic damping type step machine which greatly increases the cutting resistance of the magnetic damping device. It is still another object of the present invention to provide a transmission mechanism for a magnetic damping type step machine which greatly reduces the size of the step machine. It is still another object of the present invention to provide a transmission mechanism for a magnetic damping type step machine which is inexpensive to manufacture and easy to assemble.

DETAILED DESCRIPTION OF THE PREFERRED EMBODIMENT

Figure 2:
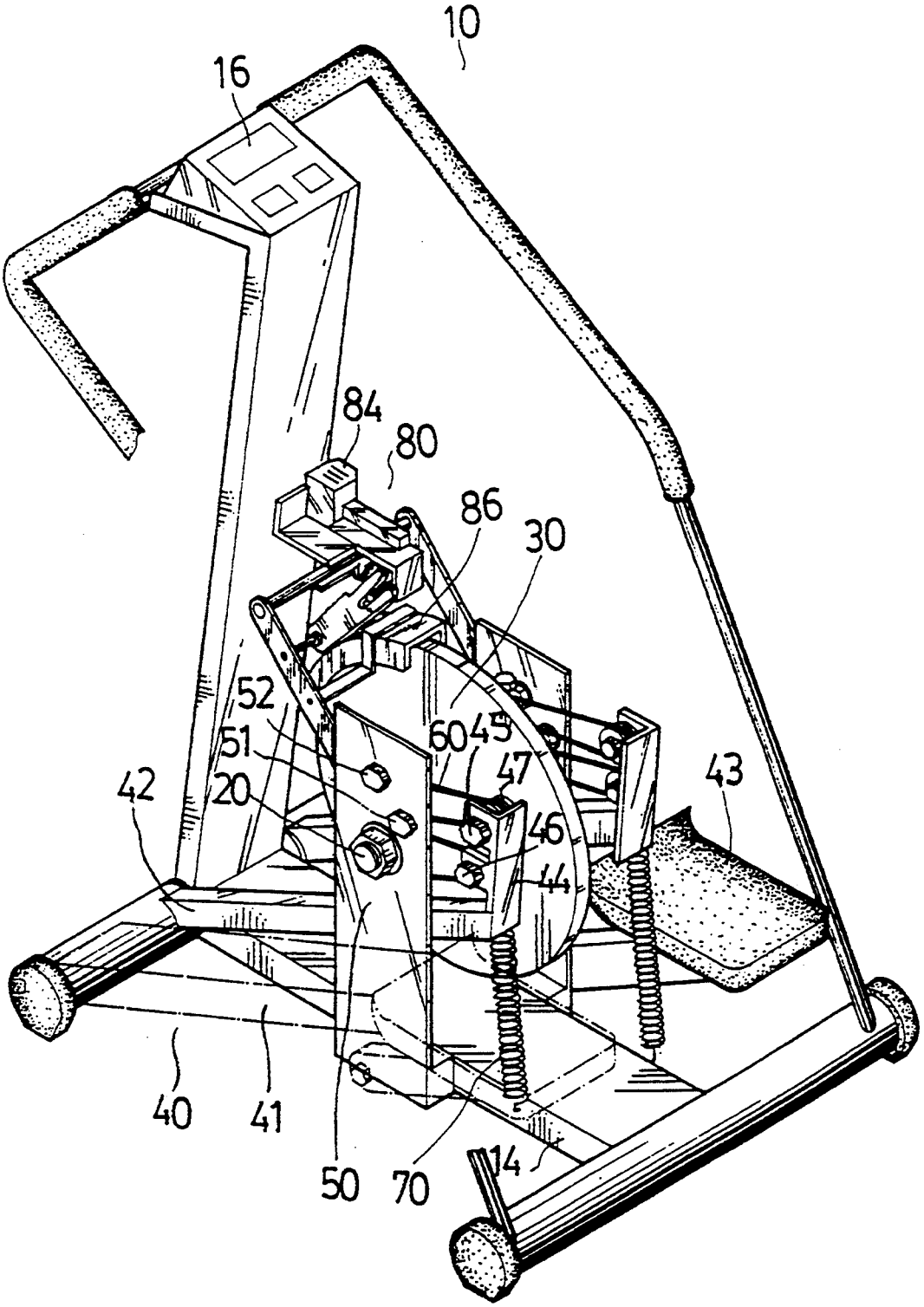
FIG. 2 is a perspective view of a magnetic damping type step machine constructed in accordance with the present invention.
Figure 3:
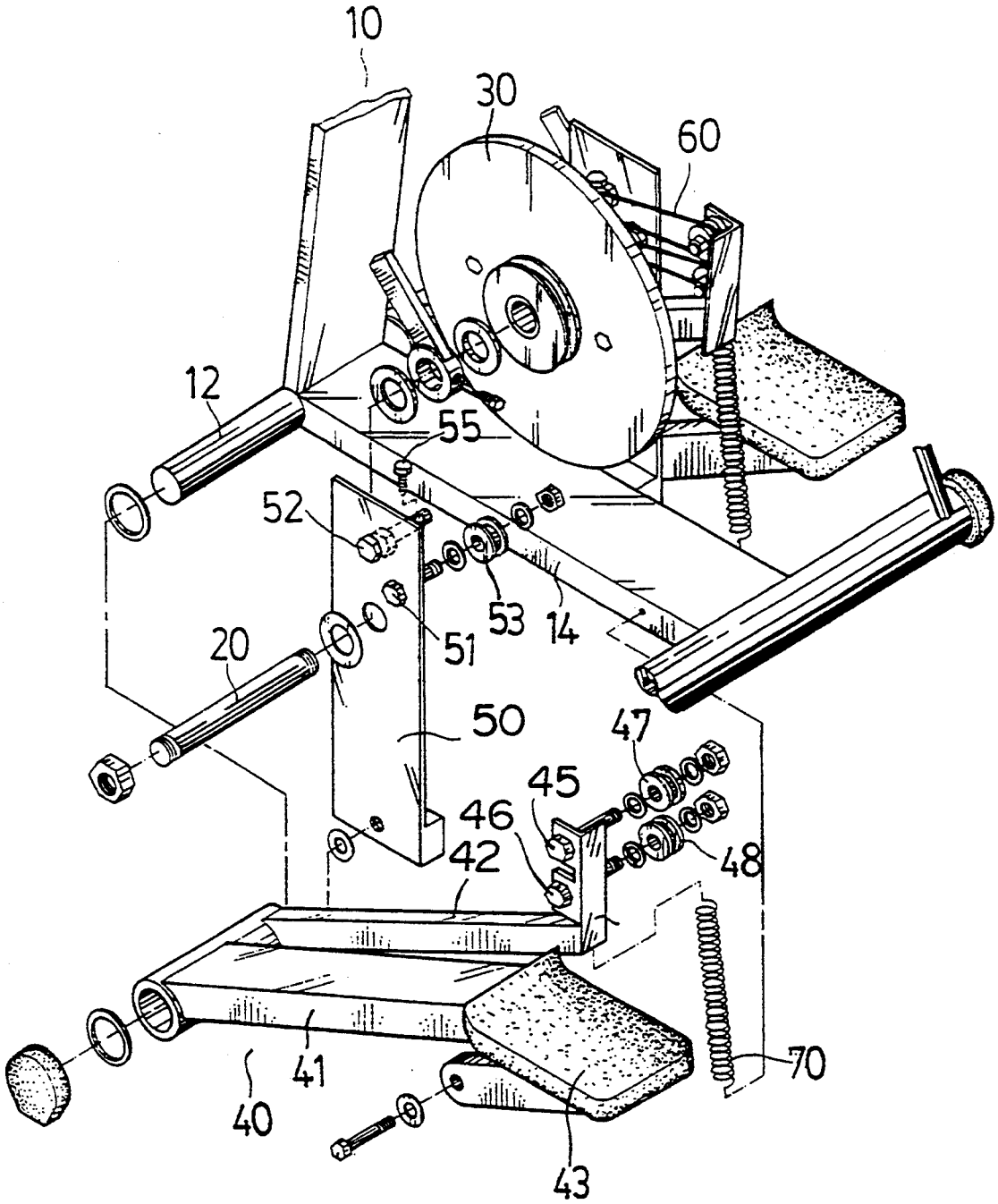
FIG. 3 is a partial exploded view of the magnetic damping type step machine shown in FIG. 2.

Referring to FIGS. 2 and 3, a transmission mechanism for a magnetic damping type step machine according to the present invention is generally comprised of a machine base 10, a main shaft 20, a flywheel 30, two pedals 40, two supporting plates 50, two transmission wires 60, two springs 70, and a magnetic damping device 80. The pedals 40, supporting plates 50, transmission wires 60, and springs 70 are symmetrically disposed at two opposite sides.

Figure 4B:
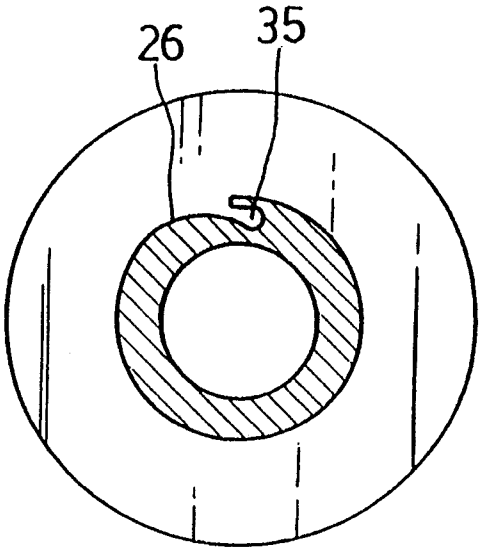
FIG. 4B is a sectional view taken on the line B—B of FIG. 4.
Figure 4:
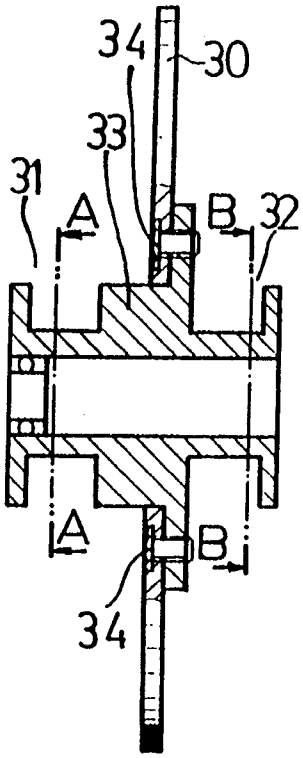
FIG. 4 is a sectional view of the flywheel and the double-groove spool of the transmission mechanism of the magnetic damping type step machine shown in FIG. 2.

Referring to FIGS. 2 and 3 again, a flywheel 30 is mounted around a double-groove spool 33 in the middle (see FIG. 4). The double-groove spool 33 is mounted around a main shaft 20 in the middle, having two annular grooves 31;32 for winding a respective transmission wire 60. Two pedals 40 are pivotably and bilaterally connected to a rear crossbar 12 at the bottom of the machine base 10. The pedal 40 comprises a pedal rod 41 and a linking rod 42 disposed in parallel with each other. The pedal rod 41 and the linking rod 42 are connected at one end and then pivotably connected to the rear crossbar 12 of the machine base 10 at either side. The opposite end of the pedal rod 41 is connected to a foot plate 43. The opposite end of the linking rod 42 terminates in to an upward right angled locating plate 44. Two axles 45;46 are provided on the upward locating plate 44 at different elevations to hold two pulleys 47;48. Two supporting plates 50 are bilaterally and vertically welded to a bottom beam 14, which is perpendicularly connected to the middle of crossbar 12. The main shaft 20 is fastened between the supporting plates 50 to hold the double-groove spool 33 and the flywheel 30. Two axles 51;52 are provided on the supporting plate 50 above the main shaft 20 at different elevations, wherein the lower axle 51 holds a pulley 53 and, the higher axle 52 holds one end of a transmission wire 60. Each transmission wire 60 has one end fixed to the double-groove spool 33 and wound around either annular groove 31 or 32, and the other end wound through the pulleys 47;48;53 and then fastened to the axle 52 on the supporting plate 50. When the foot plate 43 of the pedal 40 at one side is depressed, the pulleys 47;48 are carried downwards by the locating plate 44 to stretch the respective transmission wire 60, causing the double-groove spool 33 and the flywheel 30 to turn in one direction. When the foot plate 43 of the pedal 40 at the opposite side is depressed, the flywheel 30 is driven to turn in the reverse direction.

Figure 4A:
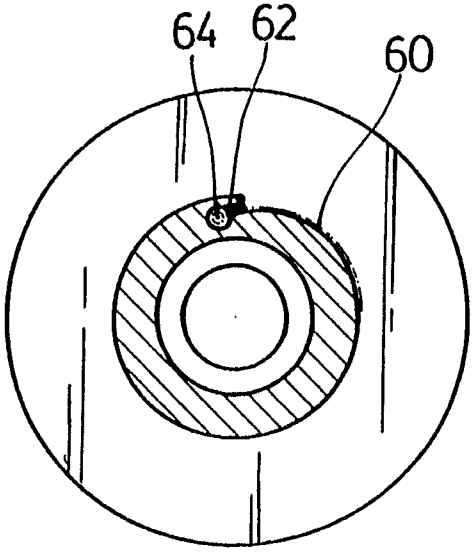
FIG. 4A is a sectional view taken on the line A—A of FIG. 4.
Figure 4C:
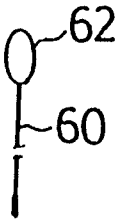
FIG. 4C is a partial view showing the end loop of the transmission wire.

Referring to FIG. 4, the flywheel 30 is fastened to the double-groove spool 33 by screws 34. Each annular groove 31;32 has a hole 35 made gradually bigger towards the bottom, and a smoothly curved sloping edge 26 connected between the hole 35 and the periphery of the respective annular groove, as seen in FIG. 4B. The smoothly curved sloping edge 26 on one annular groove 31 turns in one direction while the smoothly curved sloping edge 26 on the other annular groove 32 turns in the other direction. As seen in FIGS. 4A and 4C, one end of the transmission wire 60 is terminated to a loop 62 fastened with a rigid round block 64. By pressing the rigid round block 64 with the loop 62 into the hole 35 on either annular groove 31 or 32, the transmission wire 60 is fastened to the double-groove spool 33 and then wound around the respective annular groove 31 or 32 along the sloping edge 26.

Figure 1:
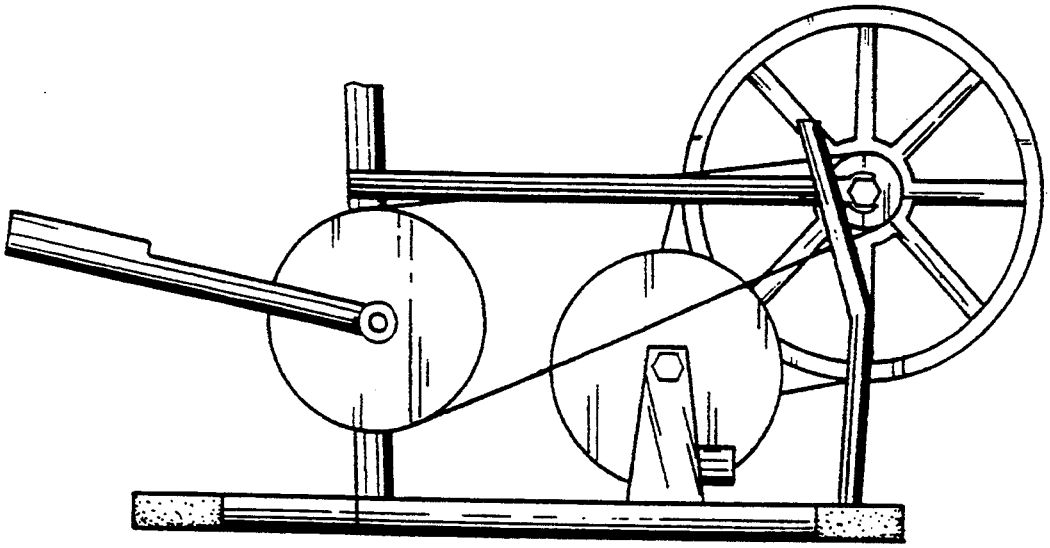
FIG. 1 PRIOR ART
FIG. 1 is a side view of a magnetic damping type step machine according to the prior art.
Figure 5:
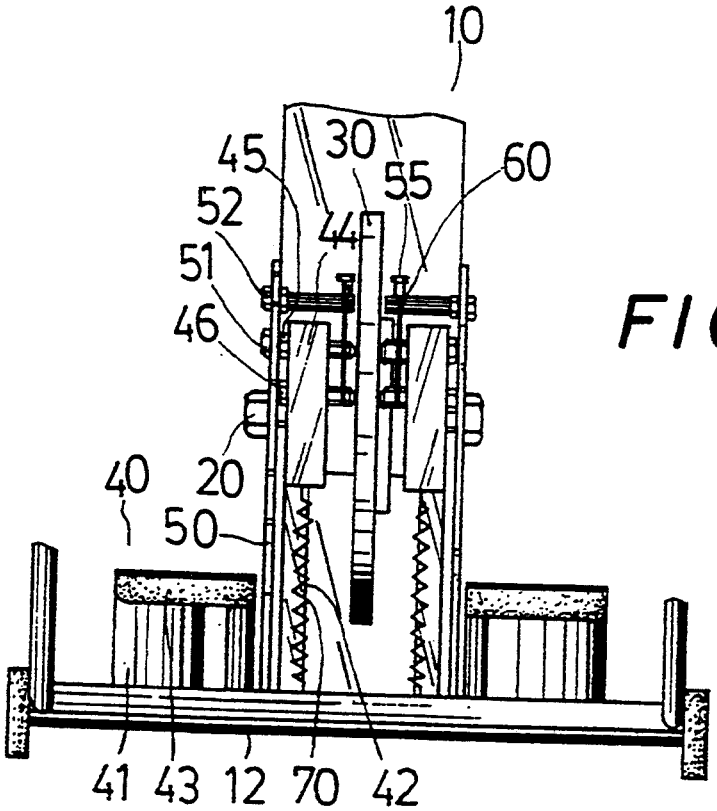
FIG. 5 is a partial front elevational view of the transmission mechanism of the magnetic damping type step machine shown in FIG. 2.

Referring to FIG. 5, therein illustrated shows the relative positions of the respective pedal 40 and the respective supporting plates 50. The supporting plate 50 at either side is disposed between the pedal rod 41 and the linking rod 42 of each respective pedal 40. The axles 51;52;45;46 project in the same direction (towards the flywheel 30), and the pulleys 53;47;48 are approximately disposed in line with the respective annular groove 31 or 32 to facilitate the winding of the respective transmission wire 60.

Figure 7:
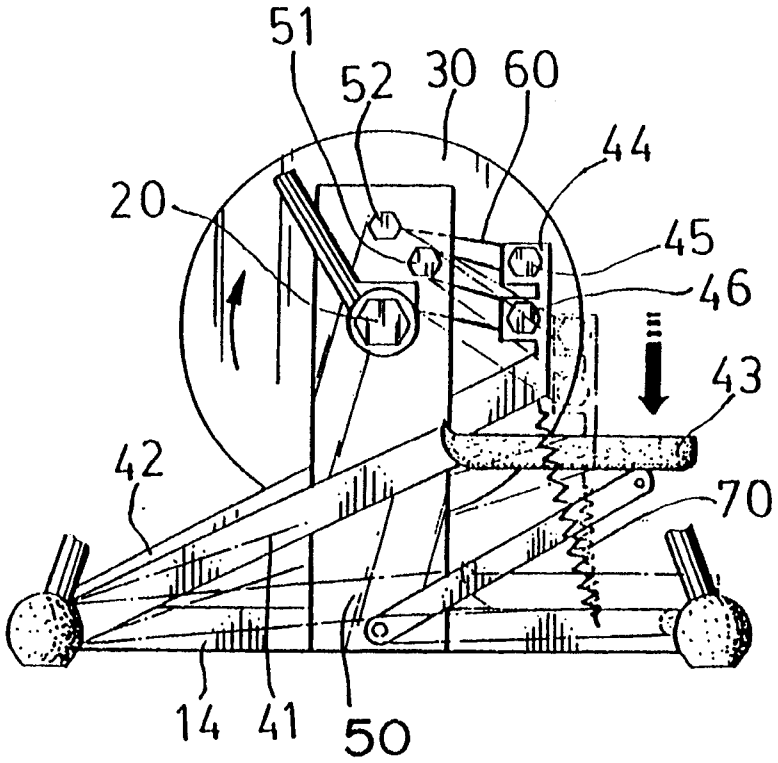
FIG. 7 is a partial right side elevational view of the transmission mechanism of the magnetic damping type step machine shown in FIG. 2.
Figure 6:
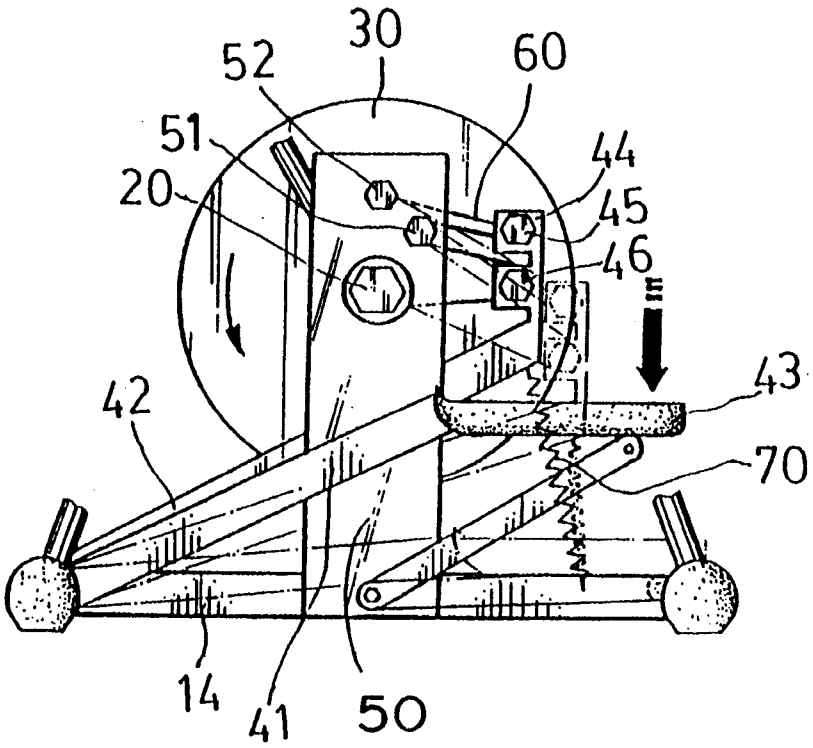
FIG. 6 is a partial left side elevational view of the transmission mechanism of the magnetic damping type step machine shown in FIG. 2.

Referring to FIGS. 4A, 6 and 7, the loop 62 of the transmission wire 60 is fastened to the hole 35 on either annular groove 31 or 32 by a respective rigid round block 64, then the transmission wire 60 is wound several turns around the respective annular groove 31 or 32 along the sloping direction of the respective sloping edge 36. This arrangement allows either annular groove 31 or 32 to let off one transmission wire 60 and simultaneously turn the flywheel 30 in one direction as one transmission wire 60 is pulled by the respective pedal 40 while the other annular groove 32 or 31 takes up the other transmission wire 60. When the other annular groove lets off the other transmission wire 60, the flywheel 30 is turned in the reverse direction. After being wound around either annular groove 31 or 32, the other end of the transmission wire 60 is turned over the pulley 48 on the lower axle 46 of the locating plate 44 of the respective pedal 40, then turned over the pulley 53 on the lower axle 51 of the respective supporting plate 50, then turned over the pulley 47 on the higher axle 45 of the locating plate 44 of the respective pedal 40, and then fixed to the higher axle 52 of the respective supporting plate 50 by a screw 55. When the foot plate 43 of either pedal 40 is stepped down to move the pedal rod 41 and the linking rod 42 downwards, the locating plate 44 is moved to carry the axles 45;46 downwards, and therefore the respective transmission cable 60 is pulled to cause the respective annular groove 31 or 32 of the double-groove spool 33 to let off the transmission cable 60. As one annular groove 31 or 32 lets off the respective transmission wire 60, the other annular groove 32 or 31 is turned to take up the respective transmission wire 60, causing the other pedal 40 to be lifted up. The two transmission wires 60 on the two annular grooves 31;32 are equal in length, and both are drawn tight to keep the two pedals 40 in the respective mid stroke positions, i.e., at the same elevation, as the pedals do no work. Further, a spring 70 is connected between the bottom beam 14 and the locating plate 44 of either pedal 40 to support the respective pedal 40 in the respective mid stroke position as the transmission mechanism of the step machine does no work.

Because the transmission wire 60 is turned over the pulleys 47;48;53, the length of the transmission wire 60 to be let off by the double-groove spool 33 is much longer than the down stroke of the pedal 40. As the pedal 40 is stepped down, the annular groove 31 or 33 of the double-groove spool 33 lets off the respective transmission cable completely. The number of turns that the transmission wire 60 is wound around the annular groove 31 or 32 is equal to the number of turns that the flywheel 30 is rotated upon each down stroke of the respective pedal 40 since the flywheel 30 and the double-groove spool 33 are coaxially connected together. This arrangement directly increases the revolving speed of the flywheel 30, and therefore the cutting resistance from the magnetic damping device 80 is relatively increased.

Referring to FIG. 2 again, the magnetic damping device 80 is comprised of a computer-controlled motor drive 84, and a permanent magnet 86 bridged over the flywheel 30 and driven by the motor drive 84. A control panel 16 is mounted on the machine base 10 at the top for controlling the operation of the motor drive 84. By controlling the distance between the permanent magnet 86 and the flywheel 30, the magnetic damping resistance is regulated. The structure of the magnetic damping device 80 is disclosed in the Wang U.S. application Ser. No. 07/741,551, and now Wang U.S. Pat. No. 5,145,480.

While only one embodiment of the present invention has been shown and described, it will be understood that various modifications and changes could be made without departing from the spirit and scope of the invention. For example, the pedal 40 can be fastened to the rear crossbar 12 by any of a variety of methods in such a manner that the pedal 40 can be turned around the longitudinal axis of the rear crossbar 12.

What is claimed is:

1. A transmission mechanism for a magnetic damping type step machine comprising:

a) a machine base including a rear crossbar and a bottom beam, the machine base having mounted thereon a main shaft, a spool, a flywheel, two pedal assemblies, two supporting plates, two transmission wires, two springs and means for imparting magnetic damping resistance to the flywheel;

b) each pedal assembly including a pedal rod, and a linking rod disposed in parallel with the pedal rod, the pedal rod and linking rod each being pivotally connected at a first end to the rear crossbar, the linking rod including a second end terminating in an upwardly extending right angled locating plate, the locating plate including a first axle disposed at a higher elevation and a second axle disposed at a lower elevation, a first pulley mounted on the first axle and a second pulley mounted on the second axle;

c) the supporting plates are secured to opposite sides of the bottom beam, with each supporting plate being disposed between the pedal rod and linking rod of each pedal assembly and including a first axle at a higher elevation and a second axle at a lower elevation, and a pulley mounted on the second axle;

d) the main shaft being secured between the supporting plates, the spool being mounted on the main shaft and including two annular grooves, the flywheel being coaxially mounted on the main shaft between the annular grooves of the spool; and e) each transmission wire having a first end thereof secured to the spool and wound around one of the an annular grooves, the wires being wound in opposite directions, and each wire thereafter being successively engaged around the second pulley on the second axle of the locating plate, the pulley on the second axle of the supporting plate, and the first pulley on the first axle of the locating plates, and each wire terminating in one of the second end secured to the first axle of a supporting plate.

2. The transmission mechanism according to claim 1 wherein the first and second axles on either supporting plate and the first and second axles on the locating plate of the linking rod of the respective pedal respectively project inwards in the same direction so that the pulley on the supporting plate and the pulleys on the locating plate of the linking rod of the respective pedal are disposed in line with the respective annular groove on said spool.

3. The transmission mechanism according to claim 1 wherein each spring has one end connected to the locating plate of the linking rod of either pedal at the bottom and an opposite end connected to said bottom beam of said machine base at either side to support the respective pedal in a mid stroke position as both pedals do not work; both transmission wires are equal in length and respectively drawn tight as both pedals are respectively disposed in said mid stroke position.

4. The transmission mechanism of claim 1 wherein:

a) each annular groove of the spool includes a mounting hole having a progressively larger dimension towards a bottom of the hole and a top opening extending to the exterior by smoothly curved sloping edge, the sloping edges of the annular grooves extending in opposite directions;

b) the first end of each transmission wire terminating in a loop disposed within a mounting hole; and c) a rigid round block retaining the first end of each wire within the mounting hole and the wire being wound around the annular groove along the sloping edge.

* * * * *